US010969108B2

(12) United States Patent
Chen

(10) Patent No.: US 10,969,108 B2
(45) Date of Patent: Apr. 6, 2021

(54) HEAT DISSIPATION DESIGN FOR COMBUSTION DEVICES

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 86 days.

(21) Appl. No.: 16/398,453

(22) Filed: Apr. 30, 2019

(65) Prior Publication Data

US 2020/0240642 A1 Jul. 30, 2020

(30) Foreign Application Priority Data

Jan. 30, 2019 (TW) ..... 108103462

(51) Int. Cl.

| | |
|---|---|
| ***F24B 1/181*** | (2006.01) |
| ***F24B 1/188*** | (2006.01) |
| ***F24B 1/19*** | (2006.01) |
| ***F24B 1/192*** | (2006.01) |

(52) U.S. Cl.

CPC ..... *F24B 1/181* (2013.01); *F24B 1/1885* (2013.01); *F24B 1/1902* (2013.01); *F24B 1/192* (2013.01)

(58) Field of Classification Search

CPC ..... F23R 3/283; F23D 11/38; F23D 14/22; F23D 4/78; F24C 3/08; F24C 3/24; F24C 3/26; F24C 5/04; F24C 5/06

USPC ..... 126/96; 431/319, 298, 320, 322, 431/331–342

See application file for complete search history.

(56) References Cited

U.S. PATENT DOCUMENTS

| | | | | |
|---|---|---|---|---|
| 3,343,586 | A * | 9/1967 | Berchtol | F23D 91/02 431/241 |
| 4,834,064 | A * | 5/1989 | Takashima | F24C 1/14 126/512 |
| 4,941,451 | A | 7/1990 | Gilham | |
| 5,263,471 | A | 11/1993 | Shimek et al. | |
| 5,388,566 | A | 2/1995 | Smith et al. | |
| 6,116,232 | A | 9/2000 | VAalters et al. | |
| 6,216,687 | B1 | 4/2001 | Campbell et al. | |
| 6,425,390 | B2 | 7/2002 | Campbell et al. | |
| 7,097,448 | B2 | 8/2006 | Chesney | |

(Continued)

FOREIGN PATENT DOCUMENTS

| | | | |
|---|---|---|---|
| CN | 202303367 | U | 7/2012 |
| EP | 2085694 | A2 | 8/2009 |

(Continued)

*Primary Examiner* — Vivek K Shirsat

(74) *Attorney, Agent, or Firm* — Alan D. Kamrath; Karin L. Williams; Mayer & Williams PC

(57) ABSTRACT

A combustion device includes a body defining a firebox, a viewing window in front of the firebox, an upper plate adjacent to a top side of the firebox, a first air passage extending from an end adjacent to a rear end of the body to a second end adjacent to a front end of the body, and a second air passage adjacent to a back side of the firebox. The second air passage has a communication opening at an end communicated with the firebox. The communication opening is at a height higher than a height of a bottom side of the firebox and lower than a height of the top side of the firebox. A burner is disposed within and adjacent to the bottom side of the firebox.

14 Claims, 8 Drawing Sheets

(56) References Cited

U.S. PATENT DOCUMENTS

| | | | |
|---|---|---|---|
| 8,268,027 | B2 | 9/2012 | Gatt |
| 8,474,729 | B2 | 7/2013 | Kaneiwa |
| 9,377,187 | B2 | 6/2016 | Chen |
| 9,441,839 | B2 | 9/2016 | Deng |
| 2005/0279344 | A1 | 12/2005 | Cyris |
| 2011/0239539 | A1 | 10/2011 | Gatt |
| 2012/0308946 | A1 | 12/2012 | Gatt |
| 2017/0009998 | A1 | 1/2017 | Yeh et al. |
| 2019/0086095 | A1 | 3/2019 | Chen |

FOREIGN PATENT DOCUMENTS

| | | | |
|---|---|---|---|
| GB | 2503574 | A | 1/2014 |
| JP | 2001336837 | A | 12/2001 |
| JP | 2006125726 | A | 5/2006 |
| SU | 1455131 | A1 | 1/1989 |

* cited by examiner

HEAT DISSIPATION DESIGN FOR COMBUSTION DEVICES

BACKGROUND OF THE INVENTION

1. Field of the Invention

The present invention relates to combustion devices and, particularly, for a combustion device design that allows enhancing the heat dissipation capability.

2. Description of the Related Art

The decorative fireplaces provide heat and are adapted to be used for ornamentation. However, these conventional indoor combustion fireplaces have smoke or incomplete combustion problems due to combustion in the limited semi-enclosed space of the house. To solve these problems, it is necessary to have a chimney that forces indoor air convection. Further, when the fireplace operates for a long period, it generates significant heat.

In recent years, a direct vent gas fireplace has become the mainstream use of large fireplaces because it intakes and exhausts outdoors, conforms to well-established regulations, and has safer peripherals. Further, in places such as an apartment or places with a fixed heating and air conditioning configuration, it is not possible to use a chimney. Therefore, in recent years, there has been growth in the market for a small-scale, but high-efficiency, chimney-free fireplace.

Chimney-free fireplaces often use gas or biofuel. The fireplace that burns biofuel is favored by some consumers mainly because the device cost is lower and installation is more convenient. Further, the fuel is easily obtainable, and being environmentally-friendly is also a concern. The types of biofuel fireplaces, which have emerged in the market in recent years, include indoor, outdoor, mobile fireplaces. The biofuel fireplace generally has a large volume and a large combustion scale. Thus, it provides a good heating and warming effect and has advantages regarding the exterior design of the fireplace, the aesthetics of a flame, and convenience. Despite the advantages, common fireplaces often create high-temperature risks due to its simple structure. Basically, the surrounding air is heated and rises during the combustion, so most of the heat will flow above the flame due to heat convection. After the surrounding air is heated, most of the heat is transferred upwards, and only a small fraction of the heat is radiated and transmitted in horizontal and below the combustion. Therefore, if the fireplace is used indoors for a long period, the high-temperature on the fireplace may cause risk to users and create damage to the surrounding.

Thus, there is a need to resolve the hot-surface problem during the combustion, especially after a long-period use. If the size of the combustion chamber of a fireplace is too small, it is difficult to dissipate heat effectively and usually creates a high surface temperature on the cosmetic that is not safe for a user to touch. A common solution to reduce the surface temperature of the fireplace is by increasing the chamber size and covering the surfaces with insulation. However, this solution often entails increasing the size of the fireplace and causing the visual effect of the flame to be mismatched with the size of the fireplace.

The present invention is, therefore, intended to obviate or at least alleviate the problems encountered in the prior art.

SUMMARY OF THE INVENTION

According to the present invention, a combustion device that allows heat dissipation includes a body having a top end, a bottom end, a front end, and a rear end, with the top end and the bottom end on opposite ends along a vertical direction, and with the front end and the rear end on opposite ends along a horizontal direction. The body defines a firebox. The body includes a viewing window, an upper plate, a first air passage, and a second air passage. The viewing window is adjacent to the front end of the body and in front of the firebox. The upper plate is adjacent to a top side of the firebox that is adjacent to the top end of the body. The first air passage is disposed on the side of the upper plate different from that of the firebox and extends from a first end that is adjacent to the rear end of the body to a second end that is adjacent to the front end of the body. An outlet of the first air passage is at the second end of the first air passage and adjacent to the viewing window. The second air passage is adjacent to the back side of the firebox that is adjacent to the rear end of the body and has a communication opening at an end communicated with the firebox. The communication opening extends along the vertical direction and is at a height higher than a height of a bottom side of the firebox and lower than a height of the top side of the firebox Further, a burner is disposed within and adjacent to the bottom side of the firebox.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
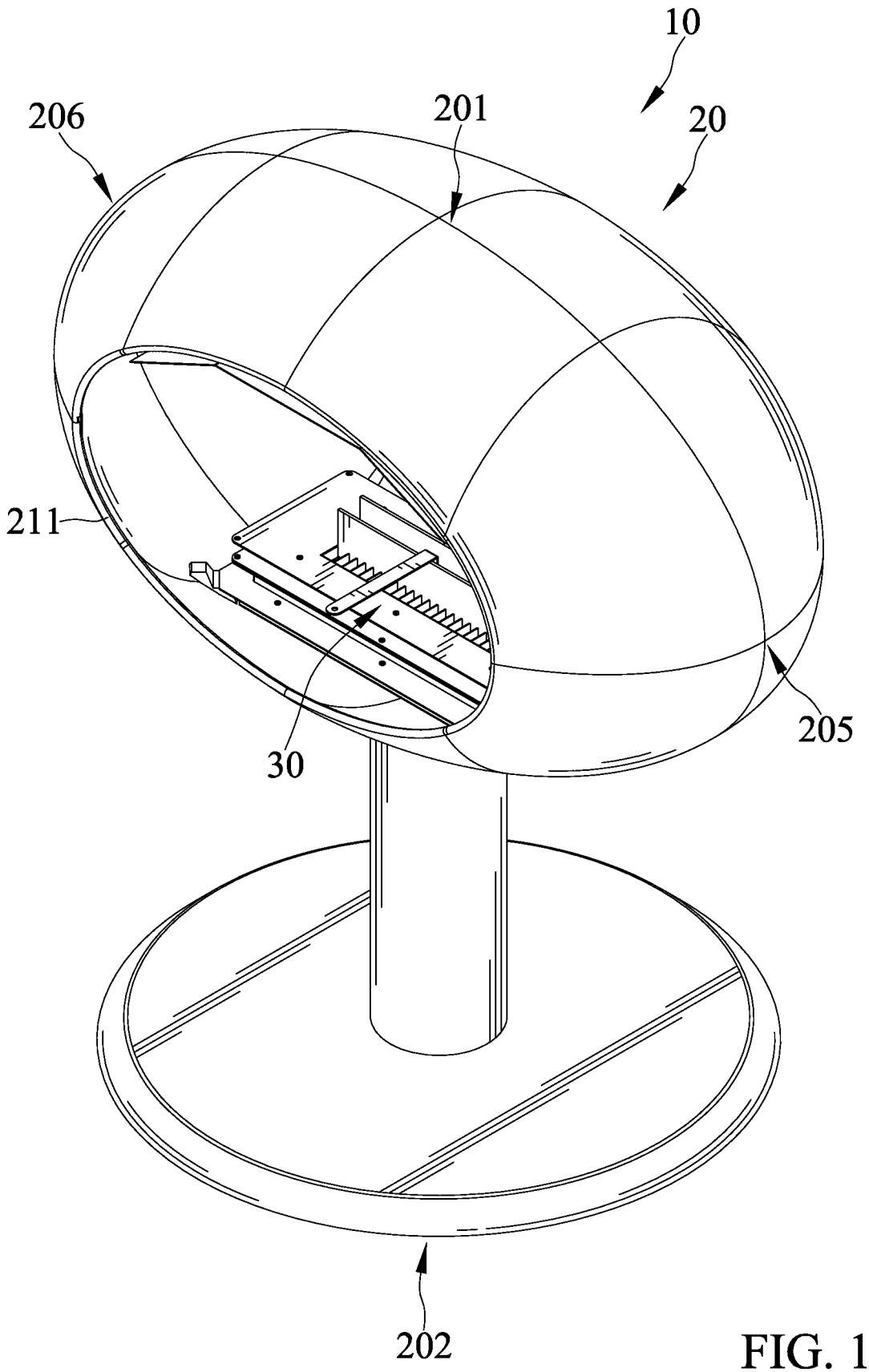
FIG. 1 is a perspective view of a combustion device adapted to dissipate heat in accordance with a first embodiment of the present invention.
Figure 2:
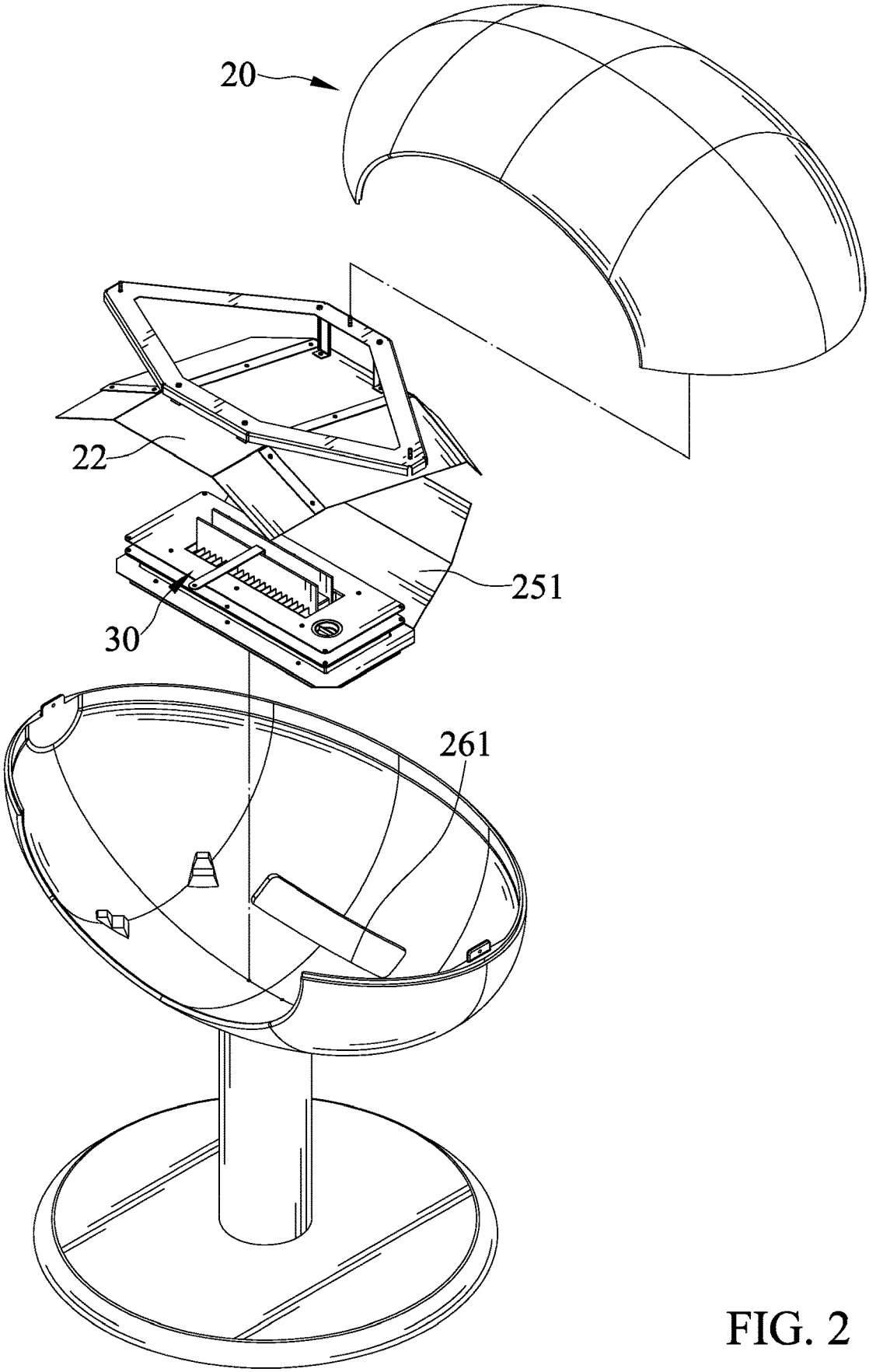
FIG. 2 is an exploded perspective view of the combustion device of FIG. 1.
Figure 3:
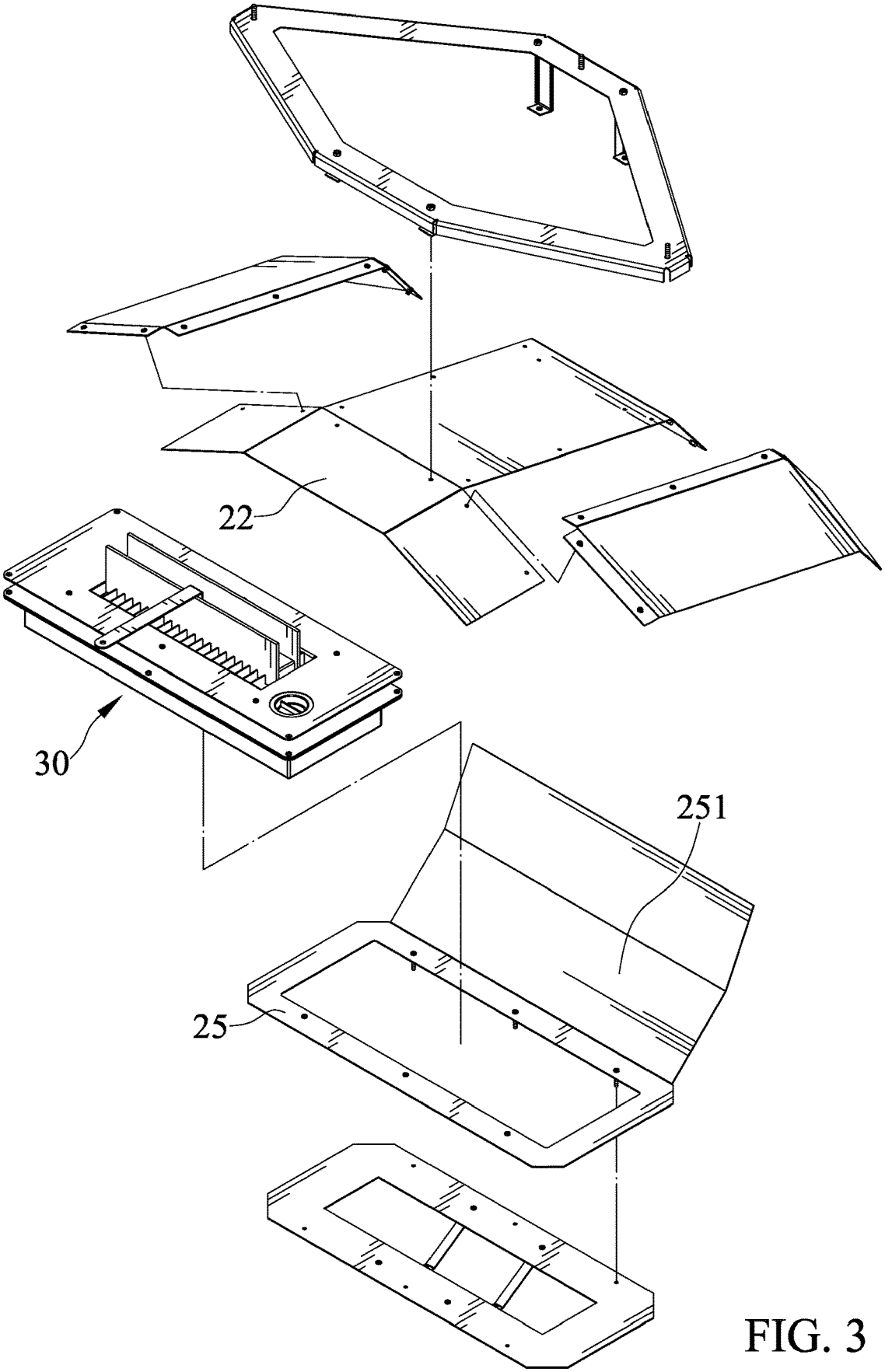
FIG. 3 is an exploded perspective view of a rack of the combustion device of FIG. 1.
Figure 4:
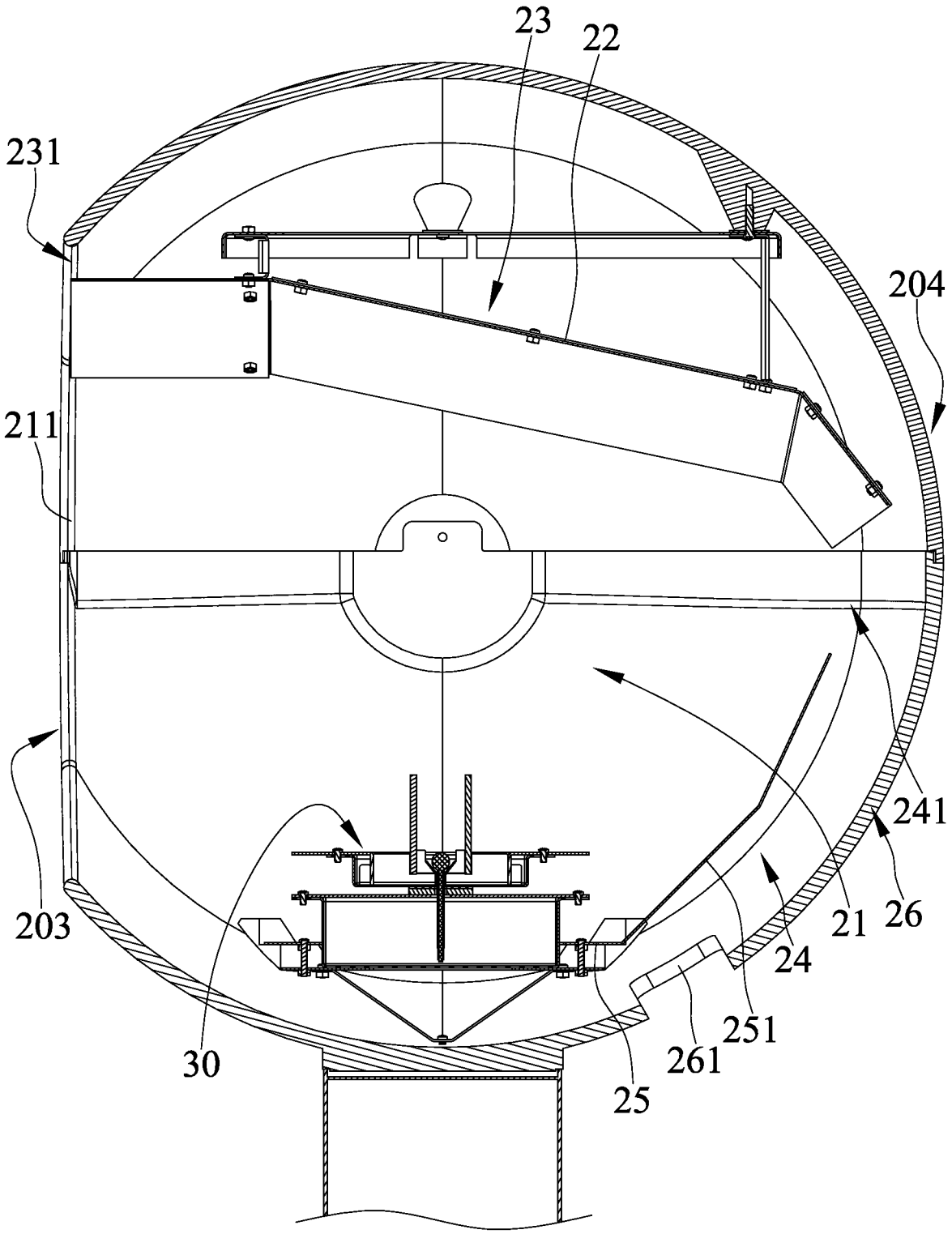
FIG. 4 is a cross-sectional view of the combustion device of FIG. 1.
Figure 5:
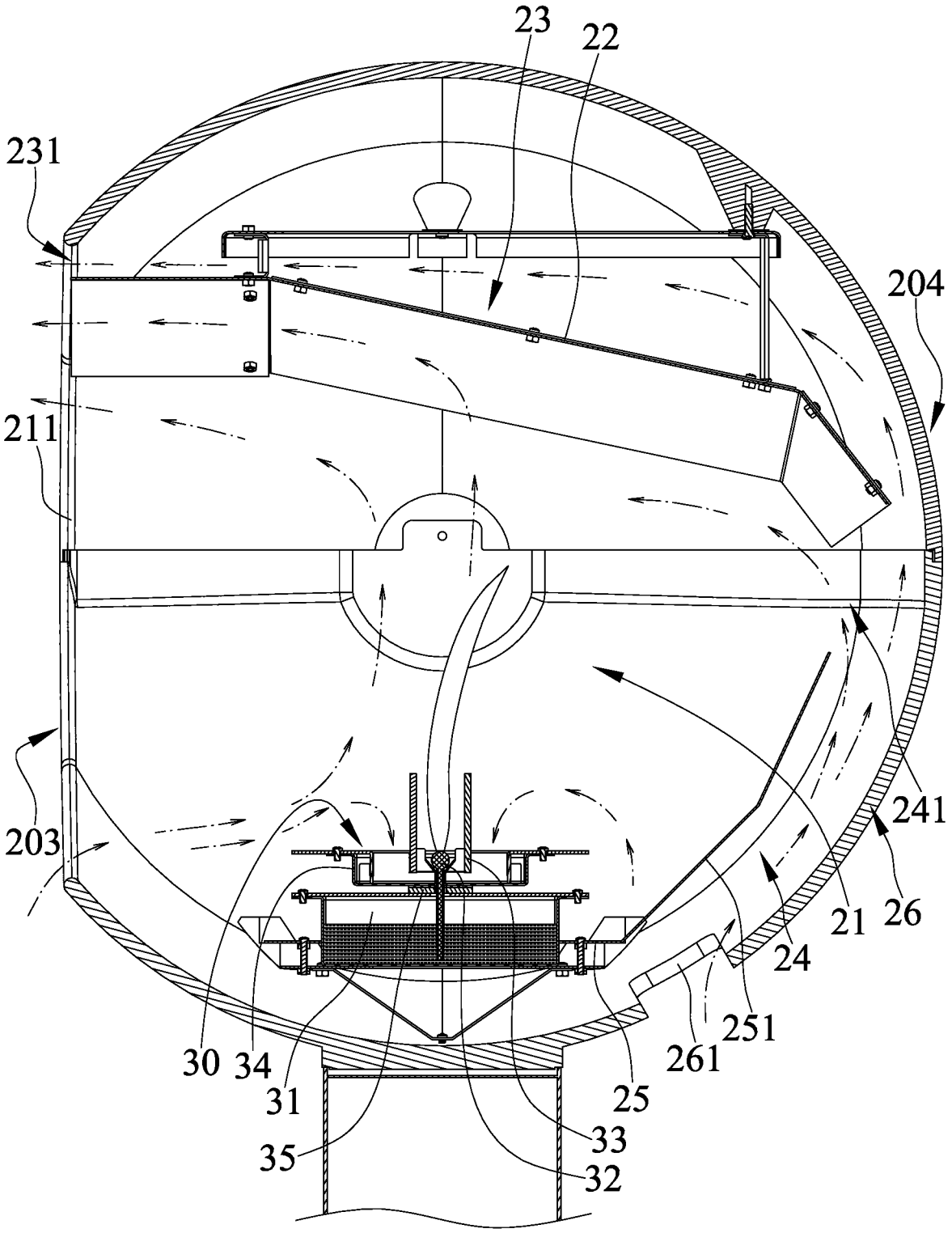
FIG. 5 is a cross-sectional view illustrating the use of the combustion device of FIG. 1, with arrows indicating heat flows.

FIGS. 1 through 5 show a combustion device 10 that allows heat dissipation. A body 20 has a top end 201, a bottom end 202, a front end 203, and a rear end 204, with the top end 201 and the bottom end 202 on opposite ends along a vertical direction, and with the front end 203 and the rear end 204 on opposite ends along a horizontal direction. The body (20) has a lateral side 205 and a lateral side 206 disposed in a spaced relationship along the horizontal direction.

The body 20 defines a firebox 21. The body 20 includes a viewing window 211. The viewing window 211 is adjacent to the front end 203 of the body 20 and in front of the firebox 21. The body 20 includes an upper plate 22. The upper plate 22 is adjacent to a top side of the firebox 21 that is adjacent to the top end 201 of the body 20. The upper plate 22 is disposed between the first and the second lateral sides 205 and 206.

The body 20 include an air passage 23 and an air passage 24. The air passage 23 is disposed on a side of the upper plate 22 different from that of the firebox 21. The air passage 23 extends from a first end that is adjacent to the rear end 204 of the body 20 to a second end that is adjacent to the front end 203 of the body 20. An outlet 231 of the first air passage 23 is at the second end of the first air passage 23 and adjacent to the viewing window 211. The air passage 24 is adjacent to a back side of the firebox 21 that is adjacent to the rear end 204 of the body 20. The air passage 24 has a communication opening 241 at an end communicated with the firebox 21 and the first air passage 23. The communication opening 241 extends along the vertical direction and is at a height higher than a height of a bottom side of the firebox 21 and lower than a height of the top side of the firebox 21.

The body 20 includes a hole adapted for inducting outside air to the second air passage 24. Specifically, an external frame 26 of the body 20 includes an air inlet hole 261 extending therein for inducting air outside of the body 20. The air inlet hole extends 261 through the body 20.

A burner 30 is disposed within and adjacent to the bottom side of the firebox 21. The body 20 includes a support 25 for the burner 30. The support 25 is adjacent to the bottom side of the firebox 21. The support 25 includes a lower plate 251 connected thereto. The lower plate 251 is spaced from the rear end 204 of the body 20 and the air passage 24 is disposed between the lower plate 251 and the rear end 204 of the body 20. The air passage 24 is disposed between the lower plate 251 and the external frame 26 of the body 20.

The burner 30 includes a fuel container 31 and a wick 32. The wick 32 burns when it is lit and includes a first distal end for drawing fuel up disposed in the fuel container 31 and a second distal end for producing a flame disposed outside the fuel container 31.

The burner 30 includes two shields 33 disposed on opposite sides of the wick 32. The second distal end of the wick 32 is disposed at a lower height than top sides of the shields 33. The flame extends along the vertical direction and between the shields 33. Further, the shields 33 can prevent the flame from blowing around excessively.

The burner 30 includes a tray 34 disposed above the fuel container 31. The wick 32 extends through the tray 34 and includes the second distal end disposed within a recess defined by the tray 34. The burner 30 includes a heat insulating member 34 disposed in a space between the fuel container 31 and the tray 34.

When the combustion devices 10 is operating, the burner 30 burns, so the temperature of the upper plate 22 increases after air heated by the burner 30 rises. Further, air in the first air passage 23 flows out of the combustion device 10 from the air outlet 231. Further, air in the viewing window 211 and adjacent to the top end 201 will be guided to flow outward by the air flow of the first air passage 23, and outside air can enter the firebox 21 from a position of the viewing window 211 that is adjacent to the bottom end 202, so that the circulation can continuously cause the heat in the firebox 21 to dissipate outwardly. Further, the combustion device 10 allows air to flow into the firebox 21 through the second air passage 24, resulting that airflows in the firebox 21 flows stably outward and the temperature of the combustion device 10 adjacent to the rear end 204 is prevented from getting too hot.

Figure 6:
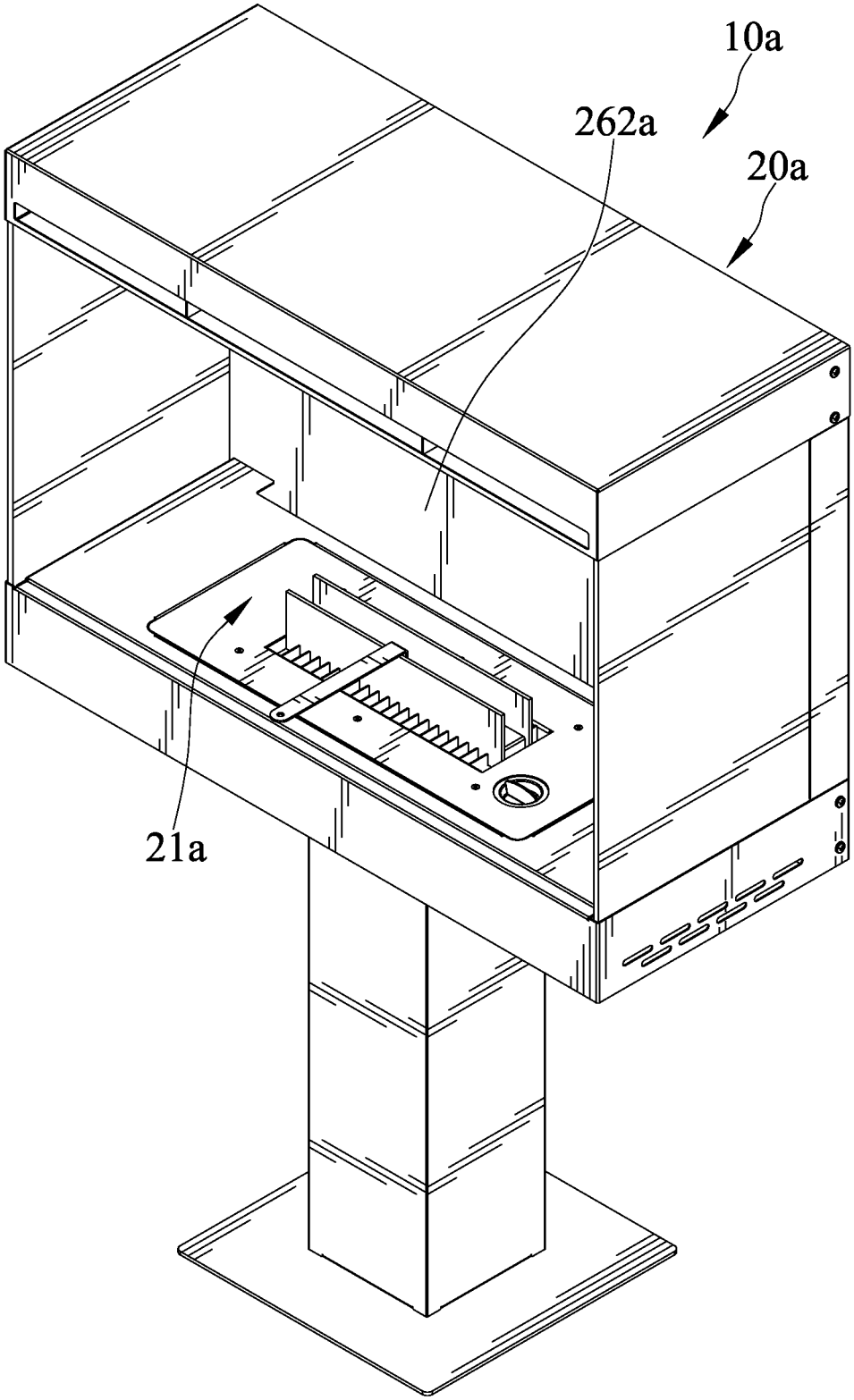
FIG. 6 a perspective view of a combustion device adapted to dissipate heat in accordance with a second embodiment of the present invention.
Figure 7:
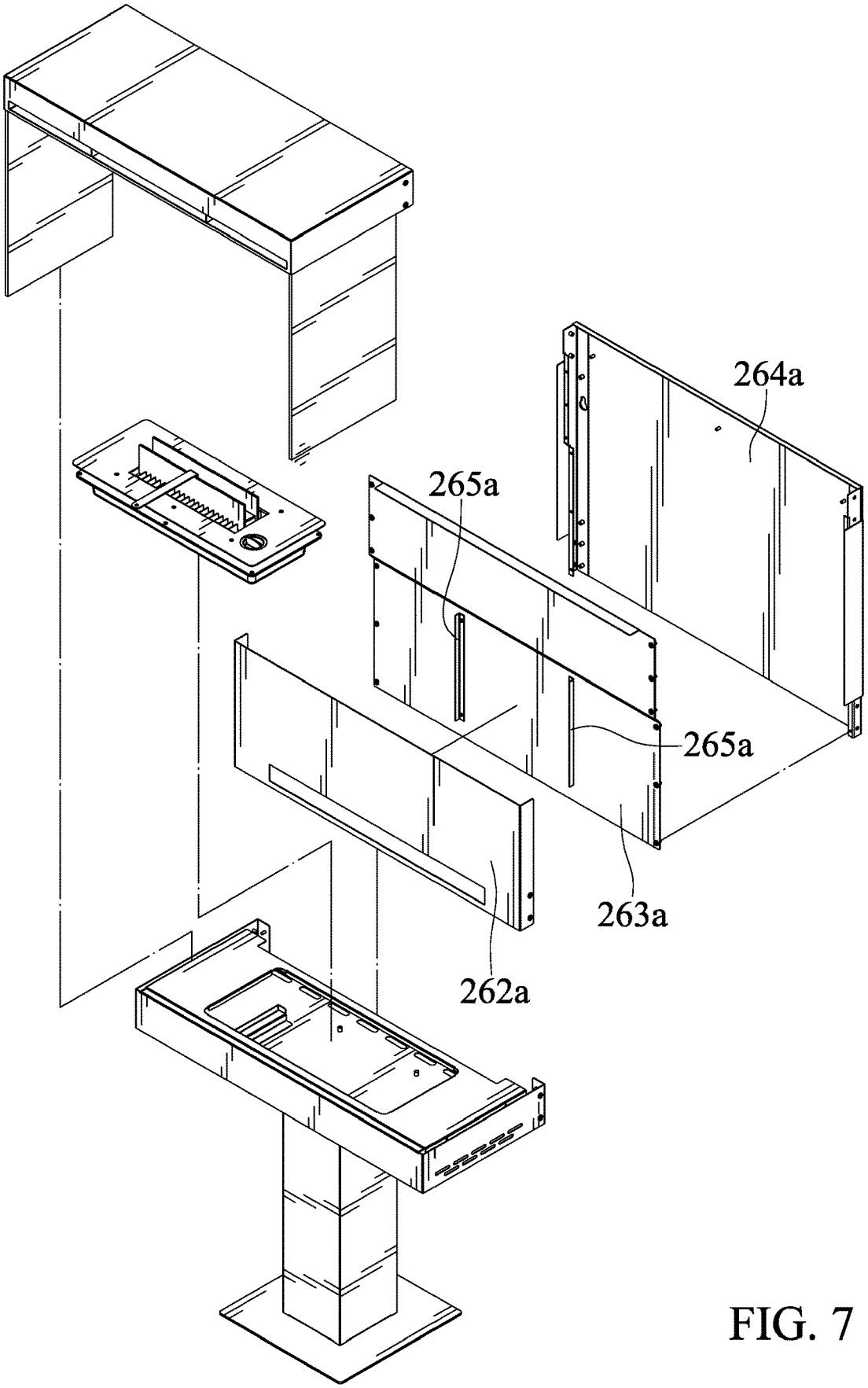
FIG. 7 is an exploded perspective view of the combustion device of FIG. 6.
Figure 8:
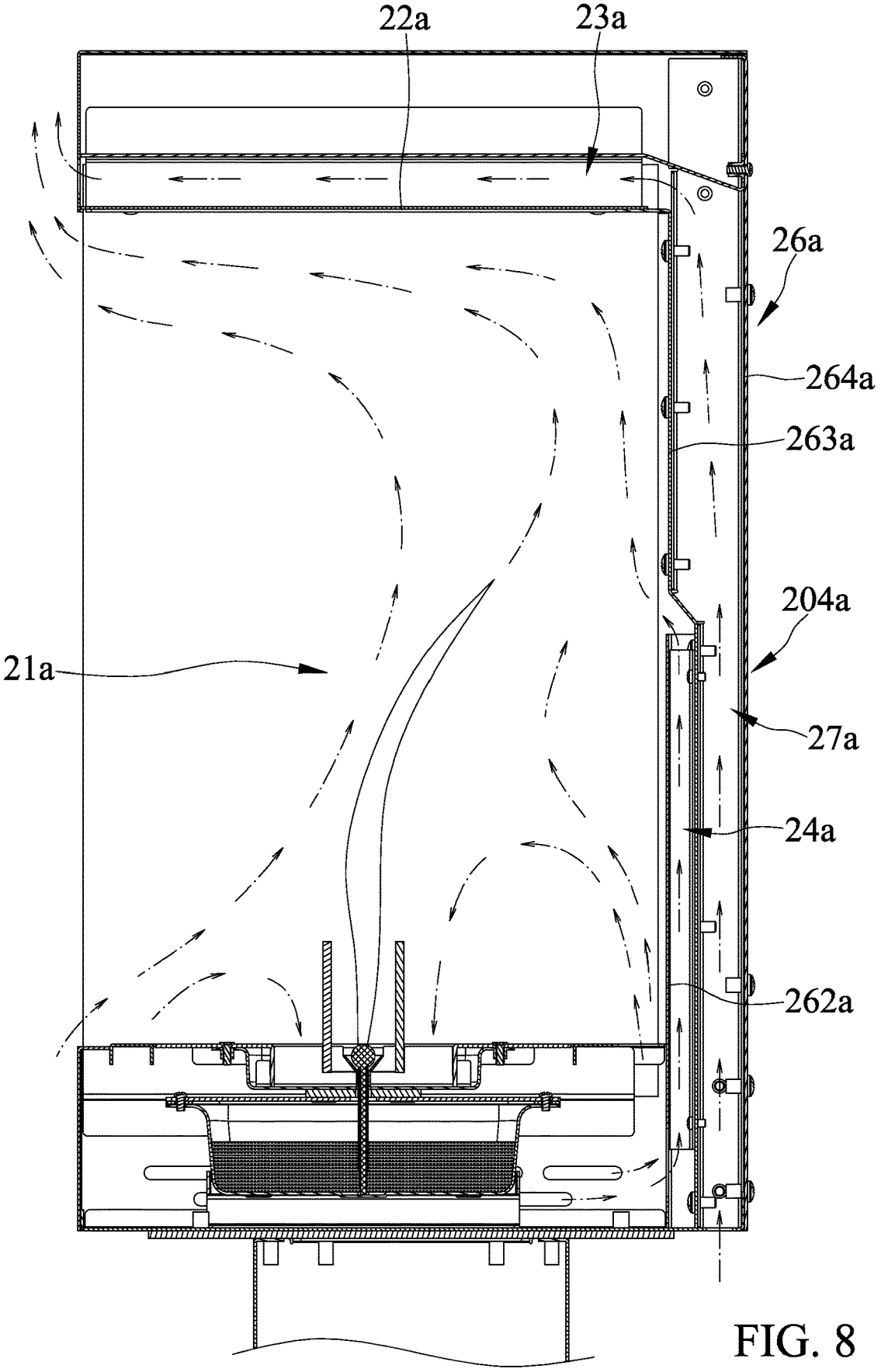
FIG. 8 is a cross-sectional view illustrating the use of the combustion device of FIG. 6, with arrows indicating heat flows.

FIGS. 6 through 8 show a combustion device 10*a* in accordance with a second embodiment of the present invention, and the same numbers are used to correlate similar components of the first embodiment, but bearing a letter a. The second embodiment differentiates from the first embodiment in that the body includes plates 262*a*, 263*a*, and 264*a* at the rear end 204*a*. The plate 263*a* behind the plate 262*a* in a spaced relationship and a second air passage 24*a* is disposed between the plates 262*a* and 263*a*. The plate 262*a* includes a front side facing a firebox 21*a* and a back side facing the plate 263*a*. The plate 264*a* is behind the plate 263*a* in a spaced relationship and a channel 27*a* is disposed between the plates 263*a* and 264*a*. The channel 27*a* is communicated with an air passage 23*a*. The channel 27*a* has an open end defining the hole that inducts outside air. Further, at least one flow partition 265*a* is disposed between the plates 262*a* and 263*a* and within the air passage 24*a*. The at least one flow partition 265*a* extends longitudinally along the vertical direction. The at least one flow partition 265*a* leads the flow in the second passage 24*a* to cool the plate disposed above the firebox 21*a*, i.e., upper plates 22*a* and the plate disposed behind the firebox 21*a*, i.e., the first and second plates 262*a* and 263*a*. In the embodiment, there are a plurality of flow partitions 265*a* disposed parallel to one another.

The merits of the combustion devices 10 and 10*a* of the present application are as follows:

When the combustion devices 10 and 10*a* are operating, the temperatures of the bodies 20 and 20*a* are relatively lower compared to that of the fireboxes 21 and 21*a*. The temperatures of the external frames 26 and 26*a* of the bodies 20 and 20*a* are less than 70 degrees Celsius and the temperatures of the plates 22, 22*a*, 251, 262*a*, and 263*a* can reach as high as 150 degrees Celsius as measured. Further, a thermo imager shows that colors of regions of the external frames 26 and 26*a* of the bodies 20 and 20*a* adjacent to the fireboxes 21 and 21*a* are yellow, colors of regions of the external frames 26 and 26*a* of the bodies 20 and 20*a* distal to the fireboxes 21 and 21*a* are green, and colors of the fireboxes 21 and 21*a* and the plates 22, 22*a*, 251, 262*a*, and 263*a* disposed at the top and the back of the fireboxes 21 and 21*a* are red, so the temperatures of the external frames 26 and 26*a* of the bodies 20 and 20*a* are relatively lower compared to that of the fireboxes 21 and 21*a* and the plates 22, 22*a*, 251, 262*a*, and 263*a*.

The foregoing is merely illustrative of the principles of this invention, and various modifications can be made by those skilled in the art without departing from the scope and spirit of the invention.

What is claimed is:

1. A combustion device that allows heat dissipation comprising:

a body having a top end, a bottom end, a front end, and a rear end, with the top end and the bottom end on opposite ends along a vertical direction, and with the front end and the rear end on opposite ends along a horizontal direction, wherein the body defines a firebox, wherein the body includes a viewing window, an upper plate, a first air passage, and a second air passage, wherein the viewing window is adjacent to the front end of the body and in front of the firebox, wherein the upper plate is adjacent to a top side of the firebox that is adjacent to the top end of the body, wherein the first air passage is disposed on a side of the upper plate different from that of the firebox and extends from a first end that is adjacent to the rear end of the body to a second end that is adjacent to the front end of the body, wherein an outlet of the first air passage is at the second end of the first air passage and adjacent to the viewing window, wherein the second air passage is adjacent to a back side of the firebox that is adjacent to the rear end of the body and has a communication opening at an end communicated with the firebox, and wherein the communication opening extends along the vertical direction and is at a height higher than a height of a bottom side of the firebox and lower than a height of the top side of the firebox;

a burner disposed within and adjacent to the bottom side of the firebox; and at least one flow partition disposed between the first and the second plates and within the second air passage, and wherein the at least one flow partition extends longitudinally along the vertical direction, wherein the body includes plates at the rear end, wherein the plate includes a first plate and a second plate behind the first plate in a spaced relationship and the second air passage is disposed between the first and the second plates, wherein the first plate includes a front side facing the firebox and a back side facing the second plate, wherein the plate includes a third plate behind the second plate in a spaced relationship and a channel is disposed between the second and the third plates, and wherein the channel is communicated with the first air passage.

2. The combustion device as claimed in claim 1, wherein the body includes a hole adapted for inducting outside air to the second air passage, and wherein the hole extends through the body and is communicated with the second air passage.

3. The combustion device as claimed in claim 1, wherein the communication opening of the second air passage is communicated with the first air passage.

4. The combustion device as claimed in claim 3 further comprising a lower plate spaced from the rear end of the body and the second air passage is disposed between the lower plate and the rear end of the body.

5. The combustion device as claimed in claim 1, wherein the body includes a support for the burner, and wherein the support is adjacent to the bottom side of the firebox.

6. The combustion device as claimed in claim 4, wherein the body includes a support for the burner, wherein the support is adjacent to the bottom side of the firebox, and wherein the support includes the lower plate connected thereto.

7. The combustion device as claimed in claim 1, wherein the body has a first lateral side and a second lateral side disposed in a spaced relationship along the horizontal direction, and wherein the upper plate is disposed between the first and the second lateral sides.

8. The combustion device as claimed in claim 1, wherein the burner includes a fuel container and a wick, wherein the wick burns when it is lit and includes a first distal end for drawing fuel up disposed in the fuel container and a second distal end for producing a flame disposed outside the fuel container.

9. The combustion device as claimed in claim 8, wherein the burner includes two shields disposed on opposite sides of the wick, and wherein the second distal end of the wick is disposed at a lower height than top sides of the shields.

10. The combustion device as claimed in claim 9, wherein the burner includes a tray disposed above the fuel container, wherein the wick extends through the tray and includes the second distal end disposed within a recess defined by the tray, and wherein the burner includes a heat insulating member disposed in a space between the fuel container and the tray.

11. The combustion device as claimed in claim 1, wherein the burner includes a fuel container and a wick, wherein the wick burns when it is lit and includes a first distal end for drawing fuel up disposed in the fuel container and a second distal end for producing a flame disposed outside the fuel container.

12. A combustion device that allows heat dissipation comprising:

a body having a top end, a bottom end, a front end, and a rear end, with the top end and the bottom end on opposite ends along a vertical direction, and with the front end and the rear end on opposite ends along a horizontal direction, wherein the body defines a firebox, wherein the body includes a viewing window, an upper plate, a first air passage, and a second air passage, wherein the viewing window is adjacent to the front end of the body and in front of the firebox, wherein the upper plate is adjacent to a top side of the firebox that is adjacent to the top end of the body, wherein the first air passage is disposed on a side of the upper plate different from that of the firebox and extends from a first end that is adjacent to the rear end of the body to a second end that is adjacent to the front end of the body, wherein an outlet of the first air passage is at the second end of the first air passage and adjacent to the viewing window, wherein the second air passage is adjacent to a back side of the firebox that is adjacent to the rear end of the body and has a communication opening at an end communicated with the firebox, and wherein the communication opening extends along the vertical direction and is at a height higher than a height of a bottom side of the firebox and lower than a height of the top side of the firebox; and a burner disposed within and adjacent to the bottom side of the firebox;

wherein the body includes a hole adapted for inducting outside air to the second air passage, and wherein the hole extends through the body and is communicated with the second air passage, wherein the body includes plates at the rear end, wherein the plate includes a first plate and a second plate behind the first plate in a spaced relationship and the second air passage is disposed between the first and the second plates, wherein the first plate includes a front side facing the firebox and a back side facing the second plate, wherein the plate includes a third plate behind the second plate in a spaced relationship and a channel is disposed between the second and the third plates, and wherein the channel is communicated with the first air passage, and wherein the channel has an open end defining the hole that inducts outside air, and further comprising at least one flow partition disposed between the first and the second plates and within the second air passage, and wherein the at least one flow partition extends longitudinally along the vertical direction.

13. The combustion device as claimed in claim 11, wherein the burner includes two shields disposed on opposite sides of the wick, and wherein the second distal end of the wick is disposed at a lower height than top sides of the shields.

14. The combustion device as claimed in claim 13, wherein the burner includes a tray disposed above the fuel container, wherein the wick extends through the tray and includes the second distal end disposed within a recess defined by the tray, and wherein the burner includes a heat insulating member disposed in a space between the fuel container and the tray.

* * * * *